US012729688B2

(12) United States Patent
Lee et al.

(10) Patent No.: US 12,729,688 B2
(45) Date of Patent: Sep. 8, 2026

(54) ELECTRIC COMPRESSOR

(71) Applicant: Hanon Systems, Daejeon (KR)

(72) Inventors: Hak Su Lee, Daejeon (KR); Kwang Jin Kim, Daejeon (KR); Ok Hyun Kim, Daejeon (KR); Duck Bin Yoon, Daejeon (KR); Won Bin Lee, Daejeon (KR); Sang Woo Jo, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 19/411,943

(22) Filed: Dec. 8, 2025

(65) Prior Publication Data

US 2026/0218706 A1 Jul. 30, 2026

(30) Foreign Application Priority Data

Jan. 24, 2025 (KR) ..... 10-2025-0011263

(51) Int. Cl.
*F04C 29/02* (2006.01)
*F04C 18/02* (2006.01)

(52) U.S. Cl.
CPC ..... *F04C 29/026* (2013.01); *F04C 18/0207* (2013.01); *F04C 2240/30* (2013.01)

(58) Field of Classification Search
CPC . F04C 29/026; F04C 18/0207; F04C 2240/30
See application file for complete search history.

(56) References Cited

U.S. PATENT DOCUMENTS 6,309,198 B1 * 10/2001 Zamudio ..... F04C 29/021 418/55.6
2005/0265878 A1 * 12/2005 Ishida ..... F04C 29/026 418/55.6
2010/0095702 A1 * 4/2010 Nomura ..... F04C 18/0215 62/470
2011/0209448 A1 * 9/2011 Watanabe ..... F01C 21/10 55/431
2011/0211977 A1 * 9/2011 Nomura ..... F01C 21/10 417/313
2019/0293072 A1 * 9/2019 Kim ..... F04C 29/028

* cited by examiner

*Primary Examiner* — Bryan M Lettman
(74) *Attorney, Agent, or Firm* — Shumaker, Loop & Kendrick, LLP; James D. Miller

(57) ABSTRACT

An electric compressor capable of preventing the occurrence of pulsation noise by increasing a volume of a discharge chamber. The electric compressor includes a housing, a compression unit, a driving unit in the housing which drives the compression unit, a rear housing having a discharge chamber through which refrigerant compressed in the compression unit is discharged, an oil separator disposed in the discharge chamber, and a bleed unit configured to communicate with a lower side of the oil separator so that some oil contained in the refrigerant discharged to the discharge chamber moves toward the oil separator.

12 Claims, 6 Drawing Sheets

ELECTRIC COMPRESSOR

CROSS REFERENCE TO RELATED PATENT APPLICATION

The present application claims the benefit of and priority to Korean Patent Application No. KR 10-2025-0011263 filed Jan. 24, 2025, the entire contents of which is incorporated herein by reference for all purposes.

FIELD OF THE INVENTION

The present invention relates to an electric compressor capable of reducing pulsation by increasing the size of a discharge chamber.

BACKGROUND OF THE INVENTION

A cooling device provided in a vehicle includes a compressor, a condenser, an expansion valve, and an evaporator, and the compressor compresses refrigerant gas discharged from the evaporator into a high-temperature, high-pressure state that facilitates liquefaction and transfers the refrigerant gas to the condenser. In addition, the compressor pumps and recirculates the refrigerant to maintain cooling.

The condenser cools and liquefies the high-temperature, high-pressure refrigerant gas by exchanging heat with outside air, and the expansion valve adiabatically expands the liquid refrigerant, thereby lowering temperature and pressure to make the refrigerant suitable for evaporation in the evaporator.

The evaporator absorbs, evaporates, and vaporizes heat from the liquid refrigerant by exchanging heat with the outside air introduced into the vehicle. The outside air is cooled by the refrigerant and is then blown into a vehicle interior by a blower.

An electric compressors is classified into a reciprocation type compressor in which a compressing part of an operating fluid (refrigerant) reciprocates, and a rotary type compressor in which compression occurs through rotation, in which the reciprocation type compressor includes a crank-type compressor, which uses a crank to transmit a driving force of a drive source to a plurality of pistons, a swash-plate type compressor, which transmits force to a rotating shaft equipped with a swash plate, and a wobble-plate type compressor, which uses a wobble plate.

For example, a scroll compressor is a type of rotary compressor in which compression occurs through the linear motion of two engaged scrolls with involute teeth.

The scroll compressor operates through the relative rotation of an orbiting scroll and a fixed scroll, which are geometrically 180 degrees out of phase within a discharge chamber, and the orbiting scroll and the fixed scroll have a scroll-shaped wrap, which has an involute curve with the same shape.

The scroll compressor forms a crescent-shaped compression chamber through the engagement of the orbiting scroll and the fixed scroll, which completes a compression cycle. The compression chamber is formed such that a volume increases toward the outside and decreases toward the center, and a suction chamber is formed outside the compression chamber, and an outlet is formed in a central portion of the compression chamber.

In the scroll compressor, in the scroll compressor, compression is performed as the sealed suction gas within a closed chamber of a given volume, defined along the outer periphery of the scrolls, is gradually reduced in volume toward the outlet by the relative rotation of the scrolls, and is then discharged through the outlet.

The refrigerant discharged from the discharge chamber can finally be discharged through the outlet after centrifugal separation through an oil separator, and stable centrifugal separation of the oil is only possible only when the refrigerant rotates stably.

A structure of the discharge chamber and oil separator provided in a conventional rear housing will be described with reference to the drawings.

Referring to FIG. 1, a conventional electric compressor (not illustrated) has an oil separator ring 3 installed on an inner upper portion of a rear housing 20 to separate oil contained in a refrigerant discharged from a discharge chamber 22.

However, there is a problem that the oil separator ring 3 partially obstructs the actual flow of refrigerant, thereby preventing stable oil separation.

In addition, when refrigerant is discharged, oil is separated, and then settles to the bottom of a rear head 2 due to its own weight, then flows back toward a refrigerant outlet by the discharged refrigerant.

In this case, in the electric compressor, the amount of remaining oil decreases, and sufficient oil cannot be supplied to a driving unit (bearings, scrolls, etc.) in which friction occurs during operation, thereby degrading the durability of the compressor due to wear or damage of driving components, an increase in temperature resulting from frictional heat, etc.

In addition, the discharge chamber 22 generates vibration noise due to pulsation as an area of the refrigerant in the limited volume is reduced by an area of the oil.

The discharge chamber 22 needs to be designed simultaneously in consideration of stable movement of the refrigerant and oil separation efficiency in the limited volume, but since vibration noise due to pulsation is also present, countermeasures are needed.

Documents of Related Art (Patent Document 1) Korean Laid-Open Patent No. 10-2023-0150211 (Oct. 30, 2023)

SUMMARY

Various embodiments of the present invention are directed to providing an electric compressor capable of storing a portion of oil in an oil storage chamber through a bleed unit communicating with a discharge chamber.

According to one embodiment of the present invention, there is provided an electric compressor including a housing, a compression unit configured to compress refrigerant, a driving unit which is provided in the housing and drives the compression unit, a rear housing having a discharge chamber through which the refrigerant compressed in the compression unit is discharged through a discharge hole, an oil separator disposed in the discharge chamber, and a bleed unit configured to communicate with a lower side of the oil separator so that some oil contained in the refrigerant discharged to the discharge chamber moves toward the oil separator.

The bleed unit may include an inlet which has a predetermined size and communicates with the discharge chamber, a passage extending from the inlet toward the oil separator, and an outlet which is open from the passage toward an inside of the oil separator, wherein the inlet may be formed to have a larger inner diameter than the outlet.

The bleed unit may further include a boss portion formed outside the oil separator.

The boss portion may be formed to have a flat upper surface.

The passage may extend obliquely so that the inlet is positioned above the outlet in a direction of gravity.

The oil separator may be formed with a refrigerant inflow hole which is open to allow the refrigerant discharged to the discharge chamber to be introduced, and the refrigerant inflow hole and the bleed unit may be disposed to be horizontally spaced apart from each other with respect to a center of the discharge chamber.

The rear housing may be formed with a partition wall forming a discharge chamber therein, the refrigerant inflow hole may be formed adjacent to an upper inner wall of the partition wall, and the bleed unit may be formed adjacent to a lower inner wall of the partition wall.

The oil separator may have an oil storage chamber formed at a lower portion, the oil storage chamber providing a space for storing oil introduced through the bleed unit.

The oil storage chamber may be surrounded by a branched partition wall branched from the partition wall.

The oil storage chamber may be positioned below the bleed unit in a direction of gravity.

The bleed unit may be formed to have a smaller size than the discharge hole.

The bleed unit may be positioned to be vertically spaced apart from the discharge hole.

The discharge hole may be positioned to be spaced apart from a virtual center line drawn at the center of the oil separator, and a center of the bleed unit may be positioned on the center line.

The bleed unit may include a boss portion formed outside the oil separator, and a bleed hole which is open from an outer surface of the boss portion toward an inner surface of the oil separator and is formed flat on an upper surface of the boss portion.

DETAILED DESCRIPTION OF THE INVENTION

Advantages and features of the present invention and methods for achieving them will become clear with reference to embodiments to be described below in detail in conjunction with the accompanying drawings. However, the present invention is not limited to the embodiments disclosed below but can be implemented in various different forms, these embodiments are merely provided to make the disclosure of the present invention complete and fully inform those skilled in the art to which the present invention pertains of the scope of the present invention, and the present invention is only defined by the scope of the appended claims. The same reference number denotes the same components throughout the specification.

When one component is "connected to" or "coupled to" another component, it includes both a case in which the one component is directly connected or coupled to another component or a case in which still another component is interposed therebetween. On the other hand, when one component is "directly connected to" or "directly coupled to" another component, it means that still another component is not interposed therebetween. The term "and/or" includes each of stated items and any combination of one or more.

Terms used herein are intended to describe the embodiments and are not intended to limit the present invention. In the present specification, the singular form also includes the plural form unless specifically stated in the phrase. As used herein, "comprises" and/or "comprising" means that the stated component, step, operation, and/or element do not preclude the presence of addition of one or more other components, steps, operations, and/or elements.

Although first, second, and the like are used to describe various components, it goes without saying that these components are not limited by these terms. These terms are only used to distinguish one component from another component.

Figure 1:
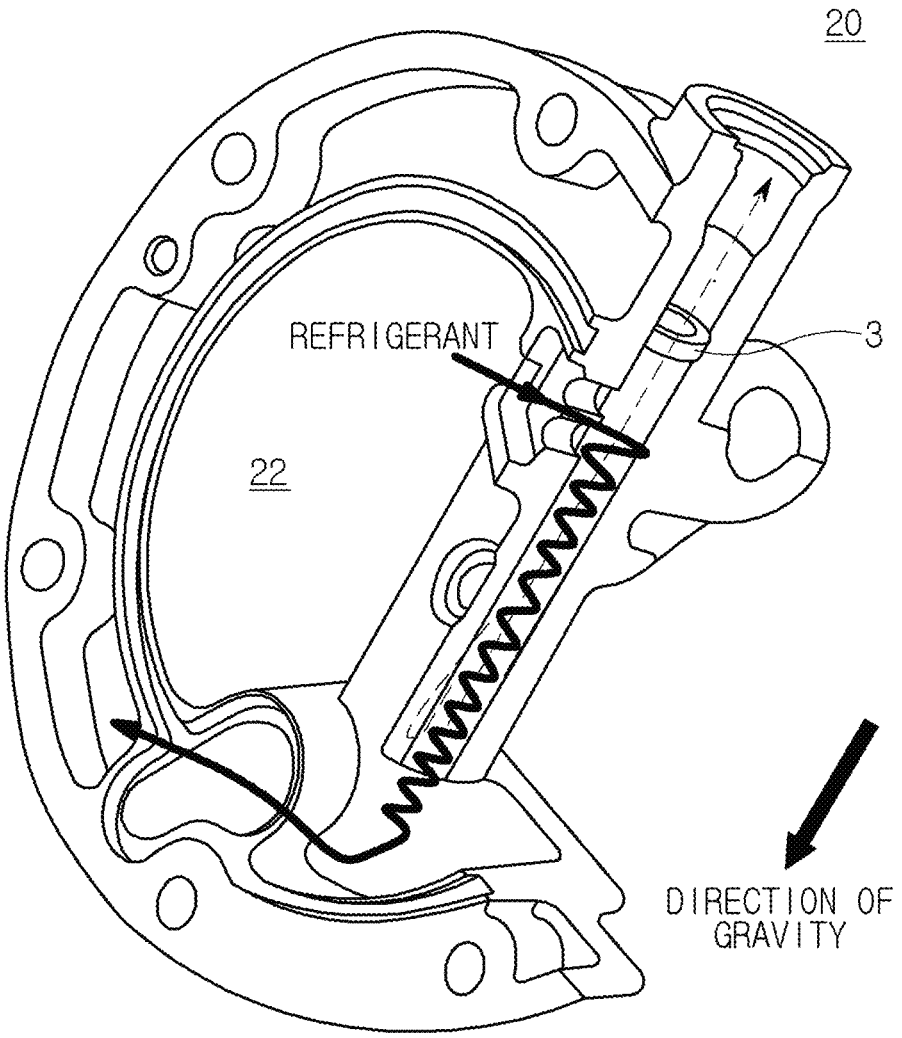
FIG. 1 PRIOR ART
FIG. 1 is a view illustrating an oil separator provided in a conventional rear housing.
Figure 2:
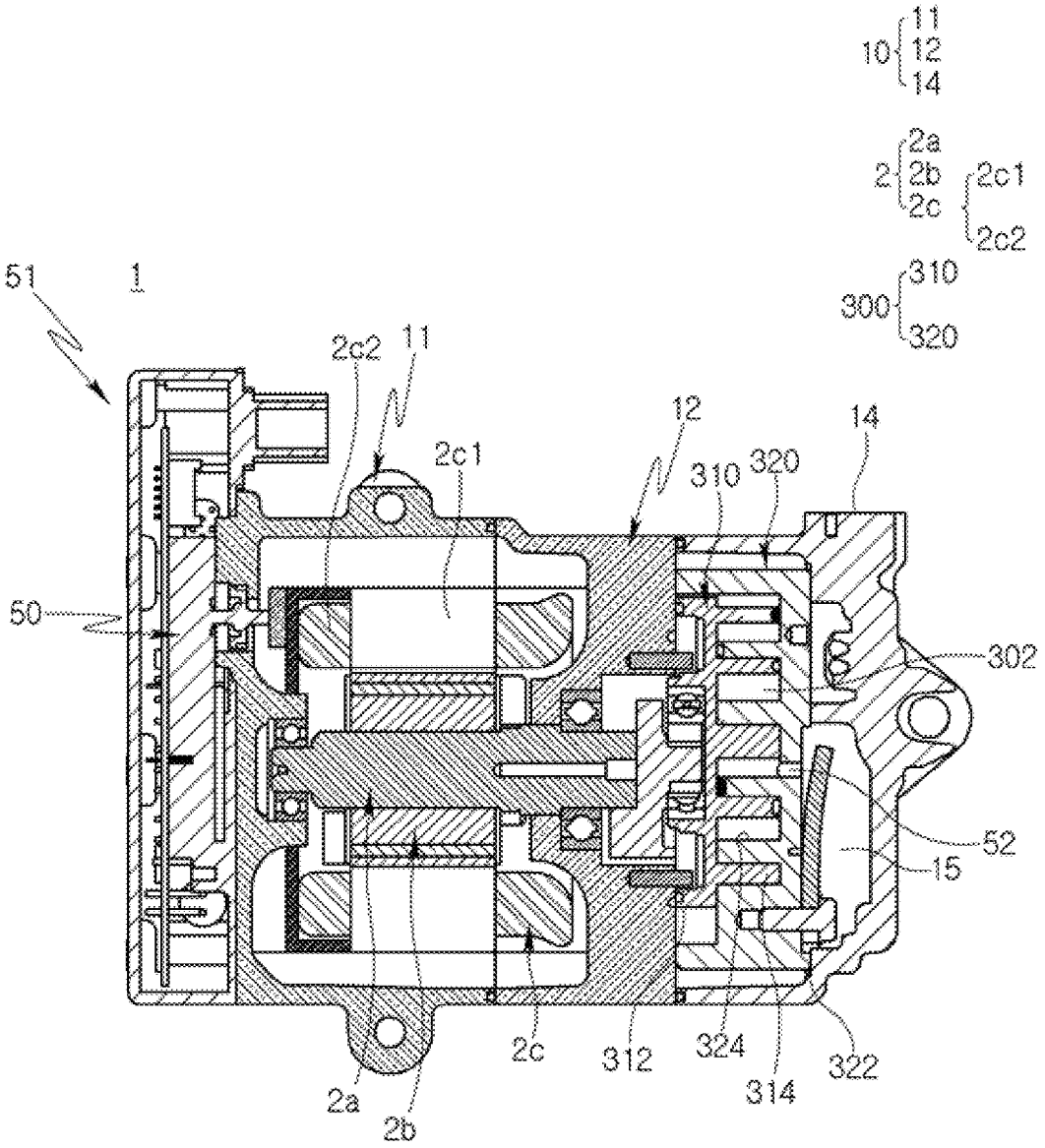
FIG. 2 is a longitudinal cross-sectional view of an electric compressor according to the present embodiment.
Figure 5:
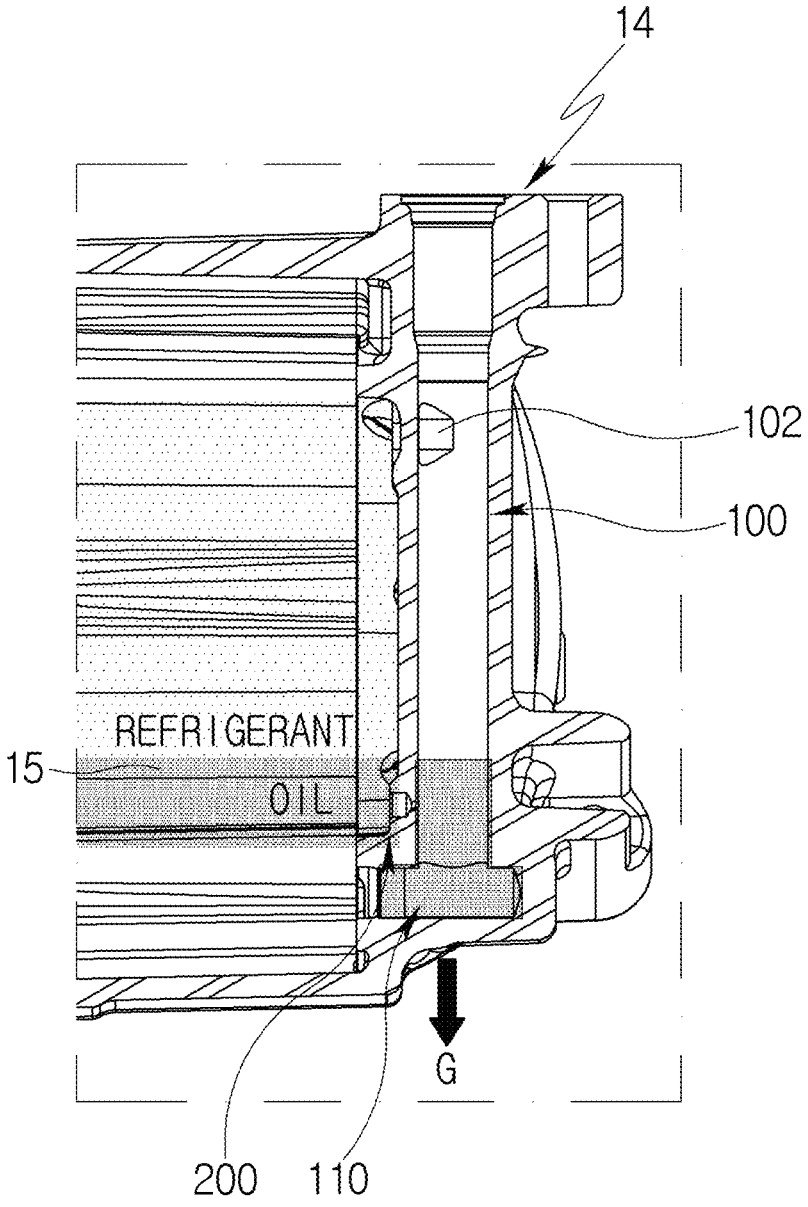
FIG. 5 is a view illustrating oil stored in a discharge chamber, an oil storage chamber, and an oil separator in the electric compressor according to the present embodiment.
Figure 6:
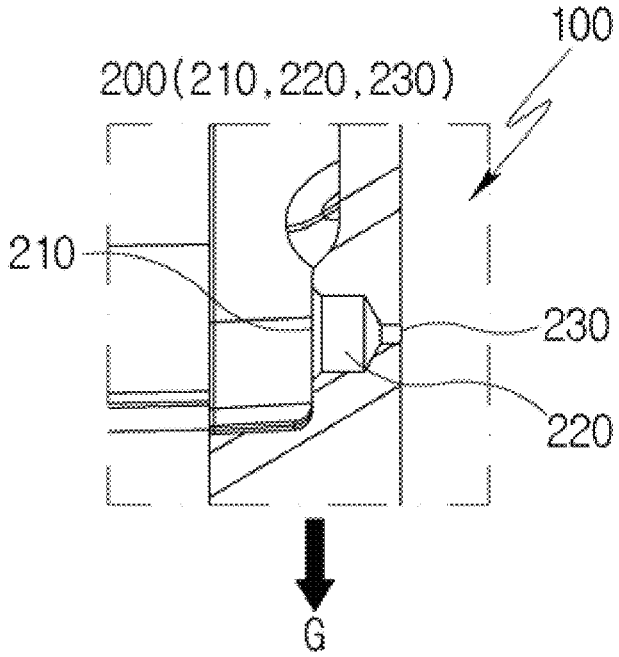
FIGS. 6 and 7 are views illustrating the bleed unit according to the present embodiment.
Figure 7:
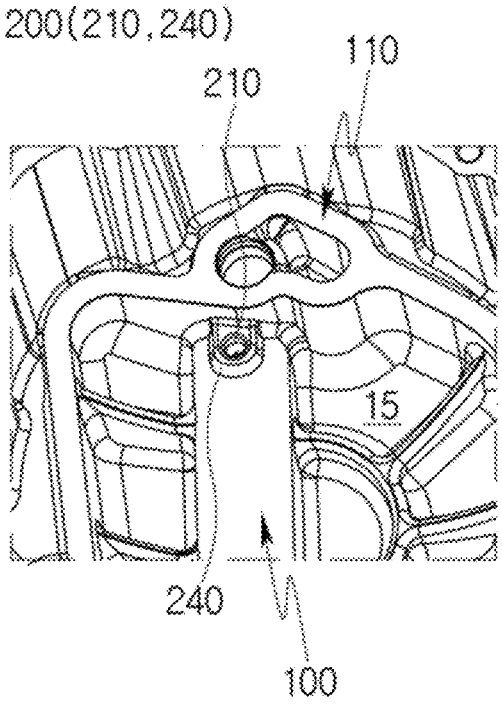

An electric compressor according to the present embodiment will be described with reference to the drawings. For reference, FIG. 2 is a longitudinal cross-sectional view of an electric compressor according to the present embodiment, FIG. 3 and FIG. are a view illustrating a discharge chamber and a bleed unit formed in a rear housing according to the present embodiment, FIG. 5 is a view illustrating oil stored in a discharge chamber, an oil storage chamber, and an oil separator in the electric compressor according to the present embodiment, and FIGS. 6 and 7 are views illustrating the bleed unit according to the present embodiment.

Referring to FIGS. 2 to 7, an electric compressor 1 according to the present embodiment includes a housing 10, a compression unit 300 which is provided in the housing 10 and compresses refrigerant, a driving unit 2 which is provided in the housing 10 and drives the compression unit 300, a rear housing 14 in which a discharge chamber 15 in which the refrigerant compressed in the compression unit 300 is discharged through a discharge hole 52 is formed, an oil separator 100 disposed in the discharge chamber 15, and a bleed unit 200 which communicates with a lower side of the oil separator 100 so that a portion of the oil contained in the refrigerant discharged to the discharge chamber 15 moves toward the oil separator 100.

The electric compressor 1 has a housing 10 that forms the overall exterior and includes a motor housing 11, a center housing 12, and the rear housing 14.

A driving unit 2 is disposed inside the motor housing 11, and the driving unit 2 supplies power required for the compression unit 300 to compress refrigerant.

The driving unit 2 includes a rotor **2*b* coupled to a driving shaft 2*a*, and a stator 2*c* fixed to the front housing 12 and disposed radially outside the rotor 2*b***.

The stator **2*c* includes a stator core 2*c*1 and a coil 2*c*2 wound around the stator core 2*c*1**.

The compression unit 300 includes an orbiting scroll 310 disposed inside the rear housing 14 and coupled to the driving shaft **2*a* through an eccentric bush, and a fixed scroll 320 fixed between the front housing 12 and the rear housing 14 to form a compression chamber 302 in which refrigerant is compressed together with the orbiting scroll 310**.

The fixed scroll 320 is disposed to face the orbiting scroll 310, and the refrigerant is compressed while the orbiting scroll 310 rotates at a predetermined speed with respect to the fixed scroll 320. The fixed scroll 320 forms the compression chamber 302 together with the orbiting scroll 310.

The orbiting scroll 310 has a spirally curved orbiting wrap 314 protruding from a rear surface thereof so as to converge toward the center, and an eccentric shaft of the driving shaft 2*a* coupled to the compression unit 300 is coupled to a central portion of the orbiting wrap 314 to revolve in synchronization with the rotor 2*b* about the driving shaft 2*a*.

The fixed scroll 320 forms the compression chamber 302 with the orbiting scroll 310, and a spirally curved fixed wrap 324 is arranged toward the center so as to align with the orbiting wrap 314 of the orbiting scroll 310. For reference, the fixed wrap 324 is formed to protrude from a fixed plate 322.

Accordingly, when the orbiting scroll 310 rotates, the mutually aligned orbiting scroll 310 and fixed scroll 320 compress the refrigerant suctioned from the compression unit 300 to outer edges of the orbiting wrap 314 and the fixed wrap 324 through the interaction of the orbiting wrap 314 and the fixed wrap 324 to the central portions thereof, respectively, and then discharge the refrigerant into the rear housing 14 through the discharge hole 52 under high pressure.

An eccentric bushing is coupled to one end of the driving shaft 2*a*, and a weight is provided on a radially outer side of the eccentric bushing. In this case, when the driving shaft 2*a* rotates, the orbiting scroll 310 rotates together, thereby compressing the refrigerant.

The compression unit 300 may be connected to the driving unit 2 through the driving shaft 2*a*, and the rotational force generated by the driving unit 2 may be transmitted to the orbiting scroll 310 of the compression unit through the driving shaft 2*a*.

An inverter unit 50 is disposed outside the housing 10 and coupled to a side opposite to the compression unit 300 with respect to the driving unit 2. The inverter unit 50 is electrically connected to the driving unit 2 and applies power to the driving unit 2 to control its operation through power and control signals transmitted from the outside.

More specifically, the stator 2*c* forms an electromagnetic field by the power applied from the inverter unit 50, and as the rotor 2*b* is rotated by the electromagnetic field generated by the stator 2*c*, the rotational force for driving the compression unit 300 is generated.

The inverter unit 50 includes a printed circuit board (PCB) on which switching elements are disposed, and an inverter cover 51 coupled to the housing 10 to accommodate the PCB.

The inverter unit 50 is coupled to one side of the front housing 12, and an inverter body and the inverter cover 51 are sequentially coupled to the front housing 12.

The inverter unit 50 is electrically connected to the driving unit and applies power to the driving unit and controls its operation through power and control signals transmitted from the outside.

More specifically, the stator generates an electromagnetic field by the power applied from the inverter unit 50, and as the rotor is rotated by the electromagnetic field generated by the stator, the rotational force for driving the compression unit 300 is generated.

The driving unit 2 and the inverter unit 50 may be electrically connected by a terminal unit. In the present embodiment, since a three-phase motor is used, three connection pins and three terminals (not illustrated) connected to three phases, respectively, may be disposed on the PCB to supply three-phase power from the inverter unit 50 to the driving unit 2.

The three connection pins are connected to the three-phase coils of the stator, respectively, and protrude into the inverter unit 50 through the front housing 12. Each of the connection pins protruding into the inverter unit 50 passes through the PCB of the inverter unit 50 and is electrically connected to the PCB through each terminal.

The refrigerant compressed in the compression unit 300 is discharged into the discharge chamber 15 formed in the rear housing 14 through the discharge hole 52 formed in the fixed scroll 50.

In particular, in the present embodiment, the structure may be changed so that the oil contained in the discharged refrigerant may move to the oil separator 100 communicating with the discharge chamber 15 in consideration of the limited size of the discharge chamber 15, and a space of an oil storage chamber 110 may be used as a space for oil storage together with the discharge chamber 15.

An arrangement relationship of a refrigerant inflow hole and a bleed unit according to the present embodiment will be described.

Figure 3:
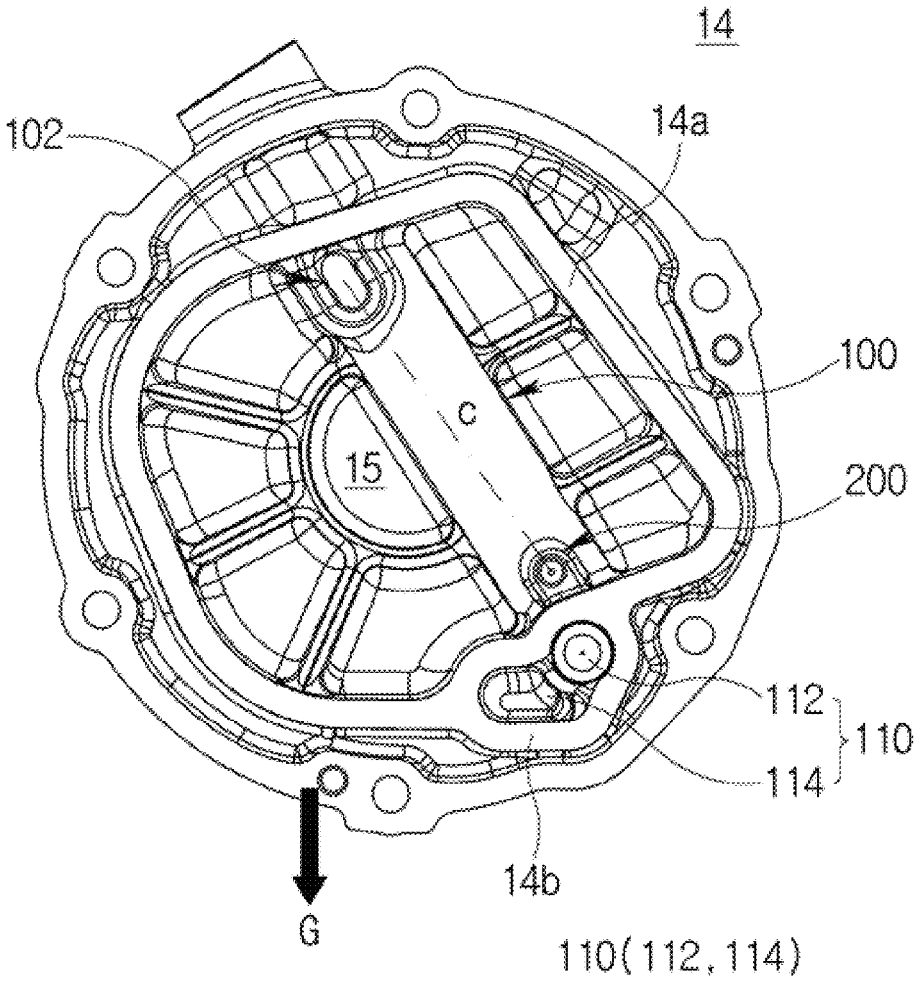
FIG. 3 and FIG. 4 are a view illustrating a discharge chamber and a bleed unit formed in a rear housing according to the present embodiment.
Figure 4:
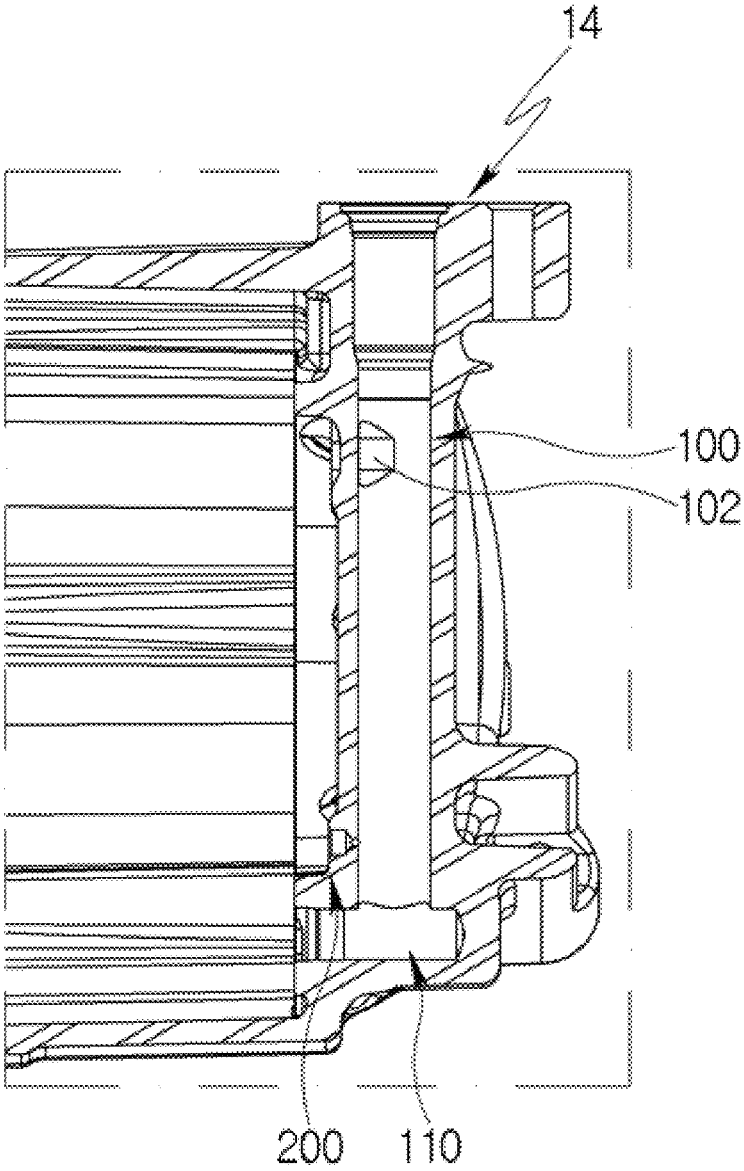

Referring to FIGS. 3 and 4, the oil separator 100 according to the present embodiment has a refrigerant inflow hole 102 that is open to allow the refrigerant discharged to the discharge chamber 15 to be introduced, and the refrigerant inflow hole 102 and the bleed unit 200 are disposed at positions spaced apart from each other in a horizontal direction with respect to the center of the discharge chamber 15.

The oil separator 100 is disposed to be inclined from an 11 o'clock direction to a 4 o'clock direction when viewed from the outside of the rear housing 14 based on the drawings, and the refrigerant inflow hole 102 through which the refrigerant discharged to the discharge chamber 15 flows is formed to extend horizontally and vertically.

The refrigerant is introduced into the refrigerant inflow hole 102 and moved downward along the inside of the oil separator 100, and thus separated into gaseous refrigerant and oil. In addition, the refrigerant moves to an inner upper portion of the oil separator 100, and the oil moves to an inner lower portion thereof due to its specific gravity.

The bleed unit 200 is formed below the oil separator 100 to allow the oil to be introduced into the oil separator 100.

A position of the bleed unit 200 corresponds to an optimal position for stably moving the oil contained in the refrigerant toward the inside of the oil separator 100 when stored in the discharge chamber 15.

The rear housing 14 according to the present embodiment has a partition wall 14*a* forming the discharge chamber 15 therein, the refrigerant inflow hole 102 is formed adjacent to an upper inner wall of the partition wall 14*a*, and the bleed unit 200 is formed adjacent to a lower inner wall of the partition wall 14*a*. For reference, the partition wall 14*a* is formed along the edge of the discharge chamber 15 having a predetermined volume, as illustrated in the drawings.

The reason why the refrigerant inflow hole 102 and the bleed unit 200 are positioned in this way is that the bleed unit 200 in which the oil contained in the discharged refrigerant primarily flows is positioned on the lower side of the discharge chamber 15 in consideration of the structure of the discharge chamber 15, a layout for stable separation of the refrigerant and the oil inside the discharge chamber 15, and the physical time required for diffusion and movement of the refrigerant and separation of the oil. In addition, the refrigerant inflow hole 102 contains some oil, and thus is spaced apart from the bleed unit 200 and positioned adjacent to the upper inner wall of the partition wall 14*a*, as illustrated in the drawings.

The refrigerant inflow hole 102 is formed adjacent to the upper inner wall of the partition wall 14*a* to allow the refrigerant to be introduced into the oil separator 100 within the limited region of the discharge chamber 15, thereby minimizing the inflow of oil and allowing the majority of the refrigerant to be introduced in a gaseous state. However, some of the oil contained in the refrigerant moved to the refrigerant inflow hole 102 is separated inside the oil separator 100 and moved to the bleed unit 200.

Since the bleed unit 200 is formed adjacent to the lower inner wall of the partition wall 14*a*, it is advantageous for the introduction of oil, which has a higher specific gravity, and thus the bleed unit 200 is positioned, as illustrated in the drawing.

In the discharge chamber 15, after being discharged, the refrigerant is diffused in the limited region, and due to the difference in specific gravity, the light refrigerant is separated into upper and central positions of the discharge chamber 15, and the oil, which has a relatively higher specific gravity than the refrigerant, is moved downward and moved through the bleed unit 200.

In the present embodiment, by allowing the oil to be stored in the inner lower portion of the oil separator 100 and the oil storage chamber 110 to be described below through the discharge chamber 15 and the bleed unit 200 using the difference in specific gravity between the refrigerant and the oil, it is possible to reduce the amount of oil stored in the discharge chamber 15 and increase the amount of stored refrigerant, thereby reducing the probability of vibration and noise due to pulsation.

When the bleed unit 200 is positioned higher than the position illustrated in the drawing, it becomes difficult for the oil to move, and thus the bleed unit 200 is preferably positioned as described above.

When the refrigerant inflow hole 102 and the bleed unit 200 are disposed in this way, a path through which the refrigerant is discharged, and then diffused and moved at a central upper side of the discharge chamber 15 is generated. In this case, the refrigerant can be moved stably throughout the entire discharge chamber 15 rather than being simply diffused and moved toward either a left or right side of the discharge chamber 15, thereby improving the stability of movement of the refrigerant.

In the present embodiment, since the bleed unit 200 is positioned further horizontally than the refrigerant inflow hole 102, the oil contained in the refrigerant is introduced into the oil separator through the bleed unit 200 while being maximally separated.

Accordingly, the oil can be stably moved from the discharge chamber 15 toward the inside of the oil separator 100.

The oil storage chamber 110 according to the present embodiment is formed below the oil separator 100 and provides a space for storing the oil introduced through the bleed unit 200.

The oil storage chamber 110 is used to reduce the percentage of the oil stored in the discharge chamber 15 and store some oil in the oil storage chamber 110.

In this case, the oil storage chamber 110 may store an amount of refrigerant corresponding to the formed volume, thereby reducing vibration noise caused by pulsation.

Since the oil storage chamber 110 is positioned below the bleed unit 200 in a direction of gravity G, storage stability is improved after the oil is introduced. Since the oil levels of the discharge chamber 15 and the oil storage chamber 110 are maintained in an aligned state, the movement of oil from the discharge chamber 15 to the oil storage chamber 110 is stably achieved, and the backflow of oil from the oil storage chamber 110 to the discharge chamber 15 is prevented.

Since the oil storage chamber 110 is surrounded by a branched partition wall 14*b* branched from the partition wall 14*a*, the oil flows through the discharge chamber 15, but the oil storage chamber 110 and the discharge chamber 15 are each configured as an independent space. In this case, only the oil may be stored in the oil storage chamber 110, thereby stably maintaining oil storage capacity.

The oil storage chamber 110 according to the present embodiment includes a first oil storage chamber 112 communicating with a lower portion of the inner side of the oil separator 100 in the direction of gravity, and a second oil storage chamber 114 communicating with the first oil storage chamber 112 and having a space for temporarily storing oil before the oil is recovered.

The second oil storage chamber 114 is formed to have a larger volume than the first oil storage chamber 112, thereby stably maintaining oil storage capacity using a region corresponding to the size illustrated in the drawing.

In this case, the oil stored in the second oil storage chamber 114 may be supplied to a suction chamber or a back pressure chamber of the electric compressor, thereby improving lubrication performance and reducing vibration through low friction.

The bleed unit 200 according to the present embodiment includes an inlet 210 communicating with the discharge chamber 15 with a predetermined size, a passage 220 extending from the inlet 210 toward the oil separator 100, and an outlet 230 that is open from the passage 220 toward the inside of the oil separator 100, and the inlet 210 has a larger inner diameter than the outlet 230.

Since the bleed unit 200 is formed to allow the movement of oil, when the oil moves from the discharge chamber 15 toward the oil separator 100, the oil moves through the passage 220.

The passage 220 may extend obliquely from the inlet 210 toward the oil separator 100 in the direction of gravity G, thereby allowing oil to more easily move toward the inside of the oil separator 100.

The inlet 210 is formed to have the same size as in the drawing to ensure stable oil entry, and the outlet 230 has a smaller inner diameter than the inlet 210, thereby preventing the oil moved to the oil separator 100 from flowing back from the outlet 230 to the inlet 210.

Accordingly, the oil is stably moved toward the inside of the oil separator 100 via the bleed unit 200 from the discharge chamber 15 to prevent a backflow, thereby improving oil separation efficiency.

The bleed unit 200 according to the present embodiment is formed to have a smaller size than the discharge hole 52 and positioned to be vertically spaced apart from the discharge hole 52. The discharge hole 52 needs to be formed to have the size illustrated in the drawing so that the refrigerant is discharged into the discharge chamber 15, and the bleed unit 200 is formed to have a smaller size than the discharge hole 52 because the bleed unit 200 only needs to allow the movement of oil.

In addition, since the bleed unit 200 is positioned to be vertically spaced apart from the discharge hole 52, only oil is mainly moved through the bleed unit 200, and the refrigerant and the oil contained in the refrigerant are discharged together through the discharge hole 52.

The discharge hole 52 according to the present embodiment is positioned to be spaced apart from a virtual center line C drawn at the center of the oil separator 100, and the center of the bleed unit 200 is positioned on the center line C.

The center line C is a virtual line formed vertically with respect to the center in a state in which the oil separator 100 is disposed to be inclined when viewed from the outside.

The center of the bleed unit 200 may be positioned on the center line C, thereby facilitating the movement of oil.

Referring to FIGS. 6 and 7, the bleed unit 200 according to the present embodiment further includes a boss portion 240 formed outside the oil separator 100.

The boss portion 240 is formed such that the inlet 210 is positioned on the center line C, rather than on the side surface of the oil separator 100. In addition, the boss portion 240 protrudes in a predetermined shape from the center line C of the outer surface of the oil separator 100, as illustrated in the drawing, so that the inlet 210 may be machined flat. For reference, the boss portion 240 may be changed into a shape other than that illustrated in the drawing.

The reason why the boss portion 240 is configured in this way is that the inlet 210 is formed flat, allowing an operator to easily perform drilling in a direction perpendicular to the oil separator 100, thereby enabling consistent work efficiency and uniform quality among operators.

Accordingly, when the boss portion 240 is configured in this manner, it is possible to simultaneously improve the operator's workability and ensure stable movement of oil from the discharge chamber 15 to the oil storage chamber 110 via the bleed unit 200.

For reference, the bleed unit 200 may also be positioned at an eccentric position to one side from the outside of the oil separator 100.

According to various embodiments of the present invention, the volume of the discharge chamber of the electric compressor can be increased and a greater amount of refrigerant than oil in the region of the discharge chamber can be stored, thereby reducing vibration noise caused by pulsation.

According to various embodiments of the present invention, the efficiency of oil separation through refrigerant recovery can be improved by moving the oil contained in the refrigerant discharged into the discharge chamber to the inner lower portion of the oil separator.

Although one embodiment of the present invention has been described above, those skilled in the art may variously modify and change the present invention by the addition, change, deletion, or addition of components without departing from the spirit of the present invention described in the appended claims, which will also be included in the scope of the present invention.

DESCRIPTION OF REFERENCE NUMERALS

2: driving unit
10: housing
11: motor housing
12: center housing
14: rear housing
15: discharge chamber
100: oil separator
110: oil storage chamber
200: bleed unit
210: inlet
220: passage
230: outlet
240: boss portion

What is claimed is:

1. An electric compressor comprising:
a housing;
a compression unit configured to compress a refrigerant;
a driving unit which is provided in the housing and drives the compression unit;
a rear housing having a discharge chamber through which the refrigerant compressed in the compression unit is discharged through a discharge hole;
an oil separator disposed in the discharge chamber; and
a bleed unit configured to communicate with a lower side of the oil separator so that some oil contained in the refrigerant discharged to the discharge chamber moves toward the oil separator, wherein the bleed unit includes:
an inlet which has a predetermined size and communicates with the discharge chamber;
a passage extending from the inlet toward the oil separator; and
an outlet which is open from the passage toward an inside of the oil separator, wherein the inlet is formed to have a larger inner diameter than the outlet.

2. The electric compressor of claim 1, wherein the bleed unit further includes a boss portion formed outside the oil separator.

3. The electric compressor of claim 2, wherein the boss portion is formed to have a flat upper surface.

4. The electric compressor of claim 1, wherein the passage extends obliquely so that the inlet is positioned above the outlet in a direction of gravity.

5. The electric compressor of claim 1, wherein the oil separator is formed with a refrigerant inflow hole which is open to allow the refrigerant discharged to the discharge chamber to be introduced, and the refrigerant inflow hole and the bleed unit are disposed to be spaced apart from each other with respect to a center of the discharge chamber.

6. The electric compressor of claim 5, wherein the rear housing is formed with a partition wall forming the discharge chamber therein, the refrigerant inflow hole is formed adjacent to an upper inner wall of the partition wall, and the bleed unit is formed adjacent to a lower inner wall of the partition wall.

7. The electric compressor of claim 6, wherein the oil separator has an oil storage chamber formed at a lower portion, the oil storage chamber providing a space for storing oil introduced through the bleed unit.

8. The electric compressor of claim 7, wherein the oil storage chamber is surrounded by a branched partition wall branched from the partition wall.

9. The electric compressor of claim 8, wherein the oil storage chamber is positioned below the bleed unit in a direction of gravity.

10. The electric compressor of claim 9, wherein the bleed unit is formed to have a smaller size than the discharge hole.

11. The electric compressor of claim 10, wherein the bleed unit is positioned to be vertically spaced apart from the discharge hole relative to an axis of the compression unit.

12. The electric compressor of claim 1, wherein the discharge hole is positioned to be spaced apart from a virtual center line drawn at a center of the oil separator, and a center of the bleed unit is positioned on the virtual center line.

* * * * *